US005220744A

United States Patent [19]

Kendall

[11] Patent Number: 5,220,744

[45] Date of Patent: Jun. 22, 1993

[54] DOWN SPOUT PLANTER APPARATUS

[76] Inventor: Gary D. Kendall, 4672 Outer Banks Dr., NE., Norcross, Ga. 30092

[21] Appl. No.: 658,532

[22] Filed: Feb. 21, 1991

[51] Int. Cl.[5] ..... A47G 7/00

[52] U.S. Cl. ..... 47/39; 248/218.4; 248/311.2; 47/70

[58] Field of Search ..... 47/39, 70; 248/218.4, 248/230, 228, 315, 311.2

[56] References Cited

U.S. PATENT DOCUMENTS 554,661 2/1898 Doolittle ..... 47/39
2,544,817 3/1951 White ..... 248/218.4
4,166,601 9/1979 Kato ..... 248/230
4,300,739 11/1981 Sande ..... 248/219.4

*Primary Examiner*—Henry E. Raduazo
*Attorney, Agent, or Firm*—Hopkins & Thomas

[57] ABSTRACT

A planter holding apparatus is adapted to be mounted on the down spout of a building and clamped in place. Where it is desired to have plants such as vegetables growing up the outside of the down spout, a second member is mounted on the down spout above the holding member and a lattice is formed therebetween. Both the holding apparatus and the second member have means for clamping them to the down spout and stabilizing means for maintaining them in proper orientation on the down spout.

11 Claims, 2 Drawing Sheets

DOWN SPOUT PLANTER APPARATUS

This invention relates to planter arrangements and, more particularly, to an apparatus for mounting flower pots and the like to a building down spout.

BACKGROUND OF THE INVENTION

In most buildings, and, more particularly, in residential homes, down spouts for draining water from the roof gutters are generally provided, which present, at best, an unsightly appearance. It is difficult to construct a home having down spouts wherein the down spouts blend into the overall structure to the point where they are unobtrusive. While such down spouts perform a necessary and desirable function, they present a stark, mechanical appearance which often interrupts the lines of a well designed house. Efforts to relieve the harshness of the appearance of the down spouts, or to enhance their appearance, have consisted of, for example, planting one or more climbing plants, such as ivy, in the ground adjacent the bottom or discharge end of the down spout and twining the climbing plant around the down spout as it grows so that, ultimately, the down spout is substantially covered with the plant. Such an arrangement produces a more pleasing appearance than a bare down spout, but, where the spout is close to the wall of the house, it is difficult to pass the growing plant between the wall and the down spout. In addition, the number of different climbing plants suitable for twining around a down spout and which are indigenous to a particular region is quite limited. Where a blooming plant is desired, the number of suitable plants is decreased still further.

The conventional down spout, because it is rigid, could supply support for tall growing plants, such as, for example, a tomato plant, but the plant would have to be tied or otherwise fastened to the down spout at intervals along its length. In addition, in the case of tomato or like plants, the side extending arms or branches could not be easily accommodated.

SUMMARY OF THE INVENTION

The present invention is an apparatus for holding or mounting a flower pot or other plant containing member on a down spout so that the plant may cover a portion of the down spout, thereby concealing it, or at least interrupting its stark appearance, with any of a number of suitable plants, blooming or otherwise. The apparatus can be located anywhere along the length of the down spout, hence it is not necessary that the plant be of the creeper or twining type, although such types of plants are not excluded.

The apparatus, in a first preferred embodiment thereof, comprises a first holder member having a first substantially planar member defining an opening, circular or otherwise for holding a flower pot or other type of planter, and a second substantially planar member spaced from the first member and defining an opening aligned with the opening in the first member. The outer peripheries of the first and second planar members are joined by a web, which defines, at the rear side of the holder member, first and second depending legs. The first and second planar members each has a cut out portion between the legs aligned with each other and shaped to embrace at least a portion of the down spout to which the apparatus is to be mounted. The cut outs in the first and second planar members define a pair of U-shaped channels extending inwardly from the legs with their open ends toward each other, and at the inner end of the channels is mounted a mounting block having first and second laterally extending ears, each of which has a bore extending therethrough.

First and second clamping members dimensioned to slide in the channels, and having gripping ends configured to grip the down spout, each has a tapped hole in its end remote from the gripping end. When the apparatus is mounted to a down spout, the clamping members ride in the channels and are fastened to the holder portion by screws or bolts extending through the bores in the ears of the mounting block and into the tapped holes in the ends of the clamping members. The ends of the depending legs are terminated in a stabilizing member shaped to embrace a portion of the down spout so that the apparatus is held firmly in place on the down spout when the clamping members are drawn into the slots by the screws or bolts, thereby clamping the apparatus in place.

In a second preferred embodiment of the invention, the peripheral web is provided with a plurality of hooks or other retaining devices arrayed around the periphery. A second holder member is adapted to be mounted to the down spout in a position spaced from and above the first holder member. The second holder member comprises a ring shaped member having first and second arms depending from a rear planar surface thereof which are joined at their distal ends by a stabilizing block adapted to bear against the down spout. The planar surface has a cut out portion between the first and second arms, with U-shaped channels formed to provide support for a pair of clamping members. The clamping members are in all respects like the first and second clamping members of the first holder member, and are drawn into the channels to clamp the second holder member to the down spout in the same way that the first holder member is clamped thereto.

The periphery of the second holder member is provided with a plurality of hooks or other retaining devices arrayed around the circumference thereof, and filamentary means such as wire or twine is threaded through the hooks on both the first and second holder members to create a plant supporting lattice extending between the first and second holder members.

The advantages and features of the present invention will be more readily apparent from the following detailed description, read in conjunction with the accompanying drawings.

DETAILED DESCRIPTION OF THE INVENTION

Figure 1:
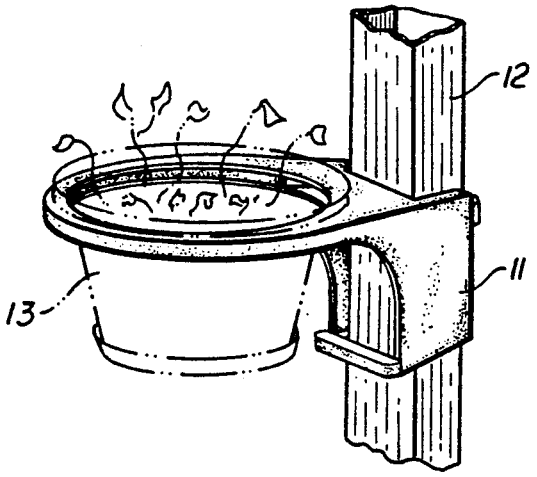
FIG. 1 is a perspective view of the holder member of the present invention mounted upon a down spout.

FIG. 1 depicts a first preferred embodiment 11 of the invention mounted on a down spout 12 and holding a flower pot 13 in which a plant or plants is growing. It can be appreciated that any number of types of plants may be used, and, where the growing plants are not twined around the down spout 12, various, different plants may be interchanged simply by changing flower pots or planters. The arrangement allows for almost unlimited decorative motifs of plants, depending upon the user's desires.

Figure 2:
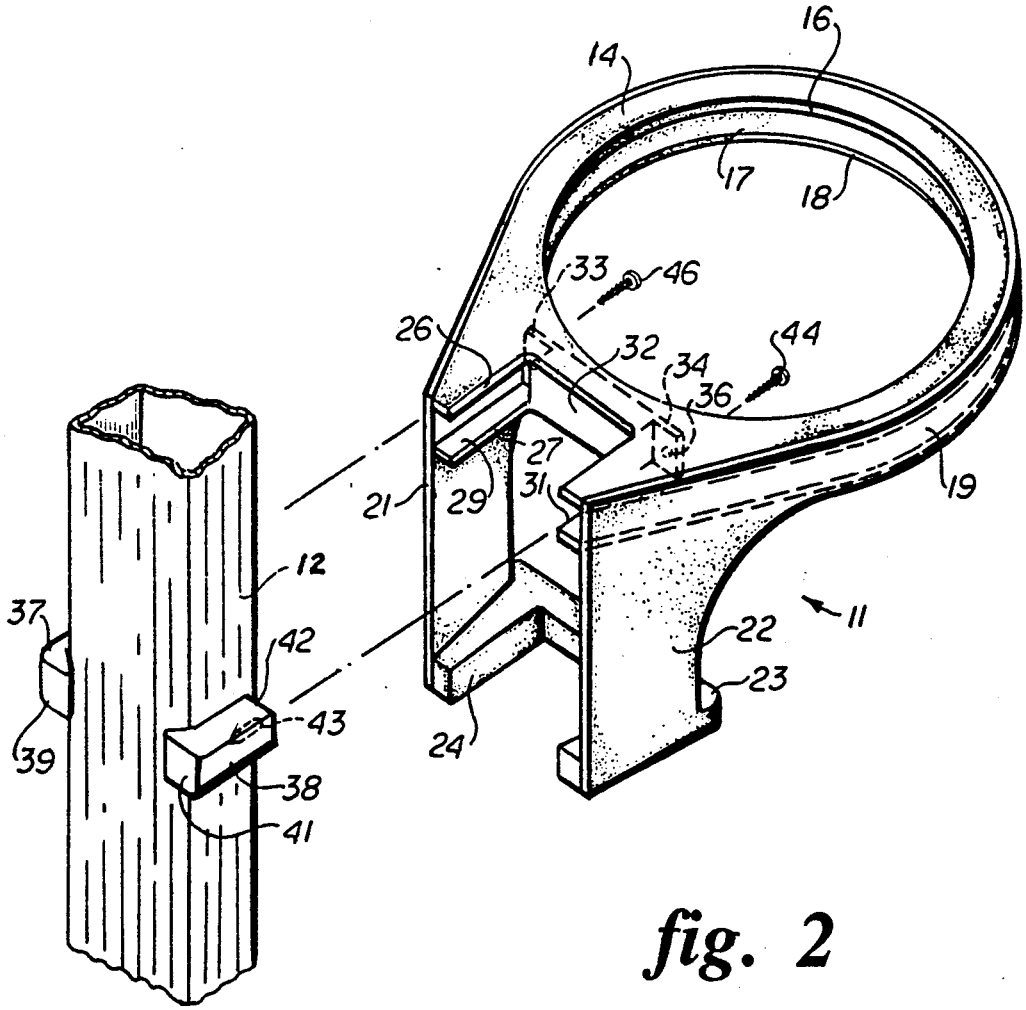
FIG. 2 is an exploded perspective view of the holder of FIG. 1.

FIG. 2 is a detailed view of the holder member 11 of FIG. 1. Member 11 comprises a first substantially planar member 14 which defines an opening 16 for holding a flower pot, for example, and a second substantially planar member 17 spaced below member 14 and likewise defining an opening 18 which is coaxial and coextensive with opening 16. The outer peripheries of members 14 and 17 are joined by a web 19 substantially at right angles thereto which, at the rear of holder member 11, defines first and second depending legs 21 and 22. The lower, or distal, ends of legs 21 and 22 have mounted thereto, as by bolting or cementing, a stabilizing member 23 having a cut-out portion 24 shaped to embrace down spout 12.

Planar members 14 and 17 have coextensive cut-out portions 26 and 27, also shaped to embrace down spout 12. It can be seen in FIG. 2 that cut-outs 26 and 27, together with web 19, form a pair of U-shaped channels 29 and 31 with their open ends facing each other. At the inner ends of channels 29 and 31 a mounting block 32 is mounted, as by bolting or cementing. Block 32 has a pair of ears 33 and 34, each having a bore of hole extending therethrough, only one of which, bore 36, is shown. Ears 33 and 34 in effect close the inner ends of channels 29 and 31.

First and second clamping members 37 and 38, having their distal ends 39 and 41, respectively, shaped to grip down spout 12, as shown, are dimensioned to ride within U-shaped slots 29 and 31 respectively. The proximal end 42 of member 38 has a tapped hole 43 therein which is substantially aligned with bore 36 when member 38 is riding in channel 31, so that a screw or bolt 44 may be passed through bore 36 and screwed into the tapped hole. In like manner, the proximal end of clamping member 37 has a tapped hole therein for receiving a screw or bolt 46.

When the member 11 is to be mounted on down spout 12, members 37 and 38 are placed as shown and channels 29 and 31 are fitted over them. Screws 44 and 46 are then tightened, drawing the holder 11 and clamping members 37 and 38 together until the assembly grips the down spout sufficiently firmly to withstand and support the weight of a planter or flower pot and the plant without slippage.

The material of which member 11, including clamps 37 and 38, is made is preferably a light weight, non-corrosive material that can withstand climatic changes without deterioration. There are a number of plastic materials that satisfy there requirements, as well as fiberglass and wood. Thermoplastic materials have the added advantage that the structure of FIG. 2 can be molded with a minimum of machining necessary to achieve the finished product. On the other hand, the use of sheets of material cut to shape and cemented or bolted together makes it possible for the structure to be assembled from a kit.

Figure 3:
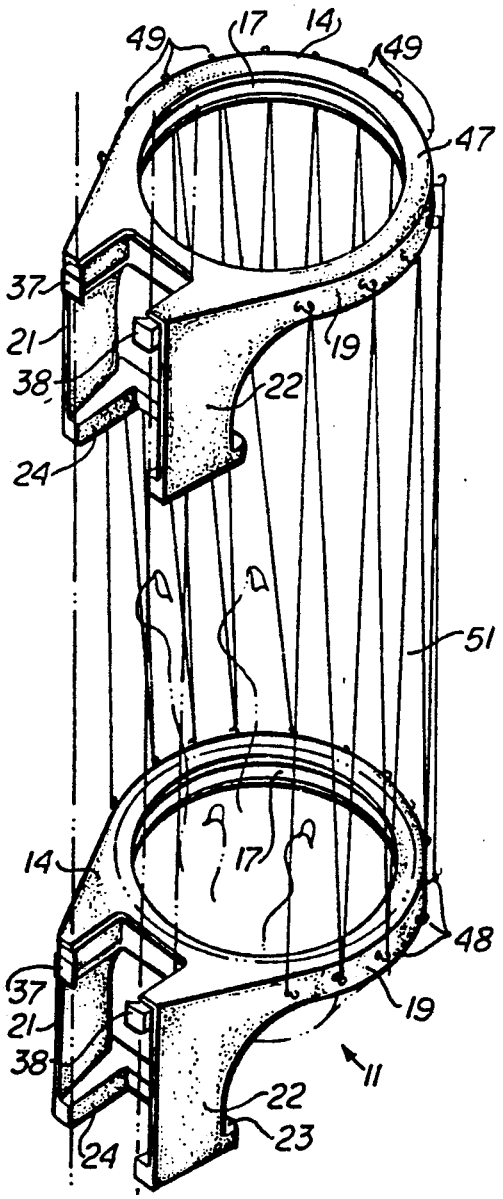
FIG. 3 is a perspective view of first and second holder members in their spaced apart configuration, with the twine lattice extending therebetween; and, FIG. 4 is a perspective view of a preferred configuration of the second holder member.

In FIG. 3 there is shown a second preferred embodiment of the invention where a second holder member 47 is adapted to be mounted to the down spout (not shown) above and spaced from holder member 11. As shown in FIG. 3, holder member 47 is substantially identical to member 11, and like parts have been given the same reference numerals.

Holder member 11 is provided with an array of spaced retaining members or hooks 48, 48 extending around the periphery and mounted on web 19 as by screwing. It is to be understood that other types of retaining members may be used instead of hooks 48, so long as they have sufficient strength, as will be apparent hereinafter. In a like manner, holder member 47 has an array of spaced retaining member 49, 49 fastened to web 19 and extending around the periphery thereof. The spacing and location of retaining members 48 and 49 is such that a filamentary means 51 such as heavy twine or wire can be looped over successive ones of members 48 and 49 to form the lattice structure shown in FIG. 3. Thus with both members 47 and 11 mounted on the down spout, each of the members 49, instead of being directly above a corresponding member 48, will be offset laterally therefrom. The twine or wire 51 should be strong enough to support a growing plant, and, where the plant is a tomato or other fruit bearing plant, it should be capable in its lattice configuration of supporting the additional weight of all of the tomatoes. This in turn places a strain on members 11 and 47, especially member 47, and on the retaining member 48 and 49. Thus it is desirable that member 11 and 47 and associated webs 19 provide a solid base for firmly securing members 48 and 49.

Figure 4:
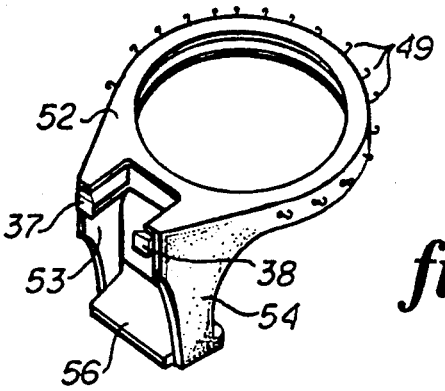

FIG. 4 depicts an alternative structure for the second holder member, and, for ease of understanding, like parts have been given the same reference numerals. The holder member 52 differs from members 11 and 47 only in the shape of its depending legs 53 and 54, and the stabilizing member 56 mounted at the distal ends of legs 53 and 54. Stabilizing member 56 is designed to butt against the down spout when member 52 is clamped thereto rather than to embrace it, as is the case with stabilizing members 23 of holding members 11 and 47.

From the foregoing, it can be seen that the apparatus of the invention comprises a relatively simple, sturdy, and attractive structure for mounting to a down spout and holding or carrying plants therein, for enhancing the appearance of a house, for example. It will readily be appreciated that the apparatus may be colored to any desired hue through the use of colored plastic or paint to enhance even further the overall appearance.

The foregoing has been for purposes of illustrating preferred embodiments of the invention. Numerous changes to, or variations of, the basic apparatus may occur to workers in the art without departure from the spirit and scope of the invention.

I claim:

1. An apparatus for mounting and supporting a planter on a down spout or the like comprising:

means forming a first holding member having an opening therein for supporting a planter, said holding member having a substantially planar top surface and a peripheral surface extending from said top surface substantially at right angles thereto;

clamping means adapted to embrace a down spout, means for securing said clamping means to said holding member; and an array of spaced retaining members affixed to said peripheral surface.

2. An apparatus as claimed in claim 1 and further comprising means forming a second holding member adapted to be mounted on a down spout and spaced from said first holding member, said second holding member having a top surface and a peripheral surface extending from said top surface.

3. An apparatus as claimed in claim 2 and further comprising an array of spaced retaining members affixed to the peripheral surface of said second holding member.

4. An apparatus as claimed in claim 2 wherein said second holding member includes means for mounting said second holding member on a down spout in alignment with said first holding member.

5. An apparatus as claimed in claim 3 and further comprising means forming a lattice structure extending between said first holding member.

6. An apparatus as claimed in claim 5 wherein said means forming a lattice structure comprises filamentary means looped over said retaining means on said first holding member and said second holding member.

7. An apparatus for mounting or holding a planter on a down spout or the like comprising:

a first holder member having a first substantially planar member forming a top surface and having an opening therein, a second substantially planar member spaced from said first planar member and having an opening therein aligned with the opening in said first planar member, a web joining the outer periphery of said first and second planar members, said web defining first and second legs depending from one side of said holder member said legs having distal ends remote from said planar members, said first planar member having a cut out portion between said first and second legs, said second planar member having a cut out portion between said first and second legs and aligned with the cut out portion of said first planar member, the cut out portions of both planar members being shaped to embrace at least a portion of a down spout and defining first and second U-shaped channels having outer and inner ends with their open sides extending toward each other, first and second clamping member adapted to slide within said channels, each of said clamping members having a distal end shaped to fit a down spout and a proximal end adapted to slide within said channels, and means for drawing said proximal ends into said channels towards the inner ends thereof.

8. An apparatus as claimed in claim 7 wherein the means for drawing said proximal ends toward the inner ends of said channels comprises a mounting block having laterally extending first and second ears substantially closing the inner ends of said channels, a bore extending through each of said ears toward said channels, a tapped hole in the proximal end of each of said camping members and aligned with the bores in said ears, and threaded means adapted to pass through said bores into said tapped hole in each of said clamping members.

9. An apparatus as claimed in claim 7 and further comprising stabilizing member mounted between the distal ends of said first and second legs.

10. An apparatus as claimed in claim 9 wherein said stabilizing member is adapted to embrace at least a portion of a down spout.

11. An apparatus for mounting and supporting a planter on a down spout secured to the exterior surface of a building structure, said apparatus comprising:

a frame having a forward portion and a rear portion;

said forward portion of said frame being formed to define an opening sized and configured to receive and support a planter of the type in which domestic plants are grown;

said rear portion of said frame being formed to define a generally U-shaped notch sized and configured to receive and embrace the front and sides of a down spout to which said apparatus is to be mounted;

a first clamping member movably secured to said frame on one side of said U-shaped notch, said first clamping member being located to extend substantially perpendicular and adjacent to one side of a down spout positioned within said U-shaped notch and having a distal end formed with an inwardly protruding finger configured to extend at least partially around a back edge of the down spout;

a second clamping member movably secured to said frame on the other side of said U-shaped notch, said second clamping member being located to extend substantially perpendicular and adjacent to the other side of a down spout positioned within said U-shaped notch and having a distal end formed with an inwardly protruding finger configured to extend at least partially around a back edge of the down spout; and means on the forward portion of said frame for selectively drawing said first and second clamping members forwardly until said fingers of said clamping members engage and bear tightly against the back edges of a down spout to which said apparatus is mounted to secure the down spout firmly within the U-shaped notch and thus to secure said apparatus to the down spout.

* * * * *